US007277666B2

(12) United States Patent
Kawano et al.

(10) Patent No.: US 7,277,666 B2
(45) Date of Patent: Oct. 2, 2007

(54) DEVELOPING APPARATUS WITH TWO TONER-SUPPLYING BODIES THAT PERIODICALLY COACT

(75) Inventors: Masahiro Kawano, Tokyo (JP); Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/999,822

(22) Filed: Nov. 30, 2004

(65) Prior Publication Data

US 2005/0123324 A1 Jun. 9, 2005

(30) Foreign Application Priority Data

Dec. 5, 2003 (JP) ..... 2003-407963

(51) Int. Cl.
*G03G 15/08* (2006.01)

(52) U.S. Cl. ..... 399/281; 399/272

(58) Field of Classification Search ..... 399/281, 399/272

See application file for complete search history.

(56) References Cited

U.S. PATENT DOCUMENTS 4,809,034 A * 2/1989 Murasaki et al. ..... 399/253
4,873,940 A * 10/1989 Ishikawa et al. ..... 399/143
4,930,438 A * 6/1990 Demizu et al. ..... 399/281
6,072,975 A * 6/2000 Kyung ..... 399/281
6,134,397 A 10/2000 Shimazaki et al.
6,208,816 B1 * 3/2001 Koizumi et al. ..... 399/27
6,829,464 B2 * 12/2004 Haraguchi et al. ..... 399/281
2005/0008402 A1 * 1/2005 Mizutani et al. ..... 399/281

FOREIGN PATENT DOCUMENTS

JP 07-160107 A 6/1995
JP 11-305532 A 11/1999
JP 2001265105 A * 9/2001

* cited by examiner

*Primary Examiner*—Quana Grainger
(74) *Attorney, Agent, or Firm*—Akin Gump Strauss Hauer & Feld LLP

(57) ABSTRACT

A developing apparatus includes a developing roller, a toner-supplying roller, and at least one toner-supplying member. The developing roller develops an electrostatic latent image formed on a photoconductive drum with toner. The toner-supplying roller is formed of a foamed material and rotates in contact with the developing roller to supply the toner to the developing roller. The toner-supplying member is disposed over the toner-supplying roller and opposes an upper surface of the toner-supplying roller. The toner-supplying member approaches the toner-supplying roller periodically to supply the toner to the toner-supplying roller. When the toner-supplying member is closest to the toner-supplying roller, the developer-supplying member and the toner-supplying roller are either in contact with each other or are spaced apart by a distance not longer than 0.8 mm.

12 Claims, 9 Drawing Sheets

DEVELOPING APPARATUS WITH TWO TONER-SUPPLYING BODIES THAT PERIODICALLY COACT

FIELD OF THE INVENTION

The present invention relates to a developer and an image-forming apparatus.

DESCRIPTION OF THE RELATED ART

Conventional electrophotographic image-forming apparatus include a printer, a copying machine, a facsimile machine, and a composite apparatus of these. A photoconductive drum is surrounded by a charging roller, an exposing unit, a developing unit, a transfer roller, and a cleaning roller. The developing unit includes primarily a developing roller and a toner-supplying roller. The charging roller charges the surface of a photoconductive drum uniformly. The exposing unit illuminates the charged surface of the photoconductive drum to form an electrostatic latent image. The developing unit applies toner to an electrostatic latent image formed on the photoconductive drum to develop the electrostatic latent image into a toner image. The toner image is then transferred onto a print medium by the transfer roller. Then, the print medium is advanced to a fixing unit where the toner image on the print medium is fused into a permanent image.

Due to repetitive cycles of image formation, toner will be exhausted and the photoconductive drum, charging roller, developing roller, and toner-supplying roller will wear out. Therefore, an image drum unit (ID unit) includes a photoconductive drum, a charging roller, a developing roller, and a toner-supplying roller assembled integrally, so that when the toner is exhausted or the photoconductive drum, charging roller, developing roller, and toner-supplying roller wear out, the entire ID unit can be replaced with a new, unused one.

FIG. 10 is a schematic view of a conventional printer and FIG. 11 illustrates the operation of a conventional developing apparatus. Referring to FIGS. 10 and 11, an ID cartridge 10 includes a photoconductive drum 11 that rotates in a direction shown by arrow A. A charging roller 12 charges the entire surface of the photoconductive drum 11 uniformly. An exposing unit illuminates the charged surface of the photoconductive drum 11 to form an electrostatic latent image. A developing roller 14 rotates in contact with the photoconductive drum 11 in a direction shown by arrow B and supplies the toner to the electrostatic latent image to develop the electrostatic latent image into a toner image. A developing blade 15 restricts the thickness of a layer of toner 31 formed on the developing roller 14, thereby setting an amount of toner 31 that is transferred from the developing roller 14 to the photoconductive drum 11. A toner-supplying roller 16 rotates in contact with the developing roller 14 in a direction shown by arrow C and supplies the toner 31 received from the a toner cartridge 21 to the developing roller 14. An agitator 28 agitates the toner 31. The developing roller 14, developing blade 15, toner-supplying roller 16, and agitator 28 form a developing unit.

A transfer roller 22 opposes the photoconductive drum 11 to define a transfer point between the transfer roller 22 and photoconductive drum 11. The transfer roller 22 rotates in a direction shown by arrow D and transfers the toner image formed on the photoconductive drum 11 onto paper 23 that passes through the transfer point. A cleaning unit 24 removes residual toner on the photoconductive drum 11 after transferring the toner image onto the paper 23. The cleaning unit 24 includes a cleaning blade 25 that is in contact with the surface of the photoconductive drum 11. The photoconductive drum 11, charging roller 12, developing unit, toner cartridge 21, and cleaning unit 24 form an ID cartridge 10.

A fixing unit 27 is located downstream of the transfer point with respect to the transport path of the paper 23 and fixes the toner image transferred onto the paper 23.

The developing unit will be described. The aforementioned developing unit is of the single-component developer type. Thus, the toner 31 is a single-component developer. The toner cartridge 21 has an opening that can be opened and closed. When the opening is opened, a predetermined amount of toner 31 falls from the toner cartridge 21 through the opening into the developing unit. The toner 31 is agitated by the agitator 28 and is supplied to the toner-supplying roller 16.

The toner-supplying roller 16 and the developing roller 14 rotate in contact with each other in the same direction but at different speeds. The potential difference between the toner-supplying roller 16 and the developing roller 14 causes the toner 31 to move from the toner-supplying roller 16 to the developing roller 14. The toner-supplying roller 16 also functions to remove excess toner from the circumferential surface of the developing roller 14. The toner-supplying roller 16 is formed of a foamed resilient material such as silicone rubber and urethane rubber, and has a plurality of cells in the shape of a recess in the circumferential surface.

The friction occurs due to the difference in rotational speed and rotational direction at a nip formed between the toner-supplying roller 16 and the developing roller 14, and causes the toner 31 to be lightly charged.

As the developing roller 14 rotates, the toner 31 on the developing roller 14 is transferred to the developing blade 15 which in turn restricts the thickness of the layer of toner on the developing roller 14. Then, the toner 31 is delivered to a development point where the developing roller 14 contacts the photoconductive drum 11. The toner 31 is attracted to the photoconductive drum 11 by the Coulomb force, thereby developing the electrostatic latent image on the photoconductive drum 11 into a toner image.

With the aforementioned conventional developing unit, as the toner-supplying roller 16 rotates in the C direction, the cells scrape the toner 31 that surround the toner-supplying roller 31, and supplies the toner 31 to the developing roller 14. When the toner 31 passes the nip formed between the developing roller 14 and the toner-supplying roller 16, the toner is subjected to mechanical stress and heat generated during printing. As a result, the toner loses its fluidity and becomes packed near the toner-supplying roller 16 after repetitive printing cycles over time.

Especially, when the toner cartridge 21 is disposed above the toner-supplying roller 16, the toner in a region AR immediately over the toner-supplying roller 16 falls by gravity onto the toner-supplying roller 16. This exerts a mechanical stress on the toner 31 and causes the toner to agglomerate.

When the toner 31 becomes packed, the apparent diameter of the toner particle becomes large and therefore decreases the ratio of the surface area of packed toner particle to its volume becomes small. This causes the toner to acquire less charge. Therefore, Vander Waals forces cannot be negligible as compared with the electrical repulsive forces among the particles of the toner 31 with the result that the particles of the toner 31 become difficult to move by the Coulomb force.

In other words, the ability of the cells to scrape the toner particles reduces, supplying less toner 31 to the developing roller 14. Especially, toner agglomeration tends to occur in the region AR1 and less toner falls onto the toner-supplying roller so that less toner is supplied to the developing roller 14.

SUMMARY OF THE INVENTION

The present invention was made in view of the aforementioned problems of the conventional developing unit.

An object of the invention is to provide a developing unit and an image forming apparatus in which a sufficient amount of developer can be supplied to the developer bearing body to improve image quality.

A developing apparatus includes:

a developer bearing body that applies developer to an electrostatic latent image formed on an image bearing body to develop the electrostatic latent image with the developer into a visible image;

a first developer-supplying member formed of a foamed material, the first developer-supplying member rotating in contact with the developer bearing body to supply the developer to the developer bearing body;

at least one second developer-supplying member disposed over the first developer-supplying member, the second developer-supplying member being adjacent to an upper surface of the first developer-supplying member and approaching the first developer-supplying member periodically to supply the developer to the first developer-supplying member;

wherein when the second developer-supplying member is closest to the first developer-supplying member, the second developer-supplying member and the first developer-supplying member are either in contact with each other or are spaced apart by a predetermined distance, for example, not longer than 0.8 mm.

The second developer-supplying member extends substantially in parallel to the first developer-supplying member, and includes at least one rod-shaped member.

The rod-shaped member is one of a plurality of rod-shaped members.

The second developer-supplying body is configured such that when the second developer-supplying body operates, the plurality of rod-shaped members approach alternately the first developer-supplying member.

The developer is supplied from over the first developer-supplying member.

The second developer-supplying member rotates about an axis and the at least one rod-shaped member is one of a plurality of parallel rods that extend parallel to the axis, wherein the plurality of rods become alternately closest to the first developer-supplying member.

The second developer-supplying member includes a first member and a second member disposed adjacent to each other.

An image forming apparatus incorporates the aforementioned developing apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

Figure 1:
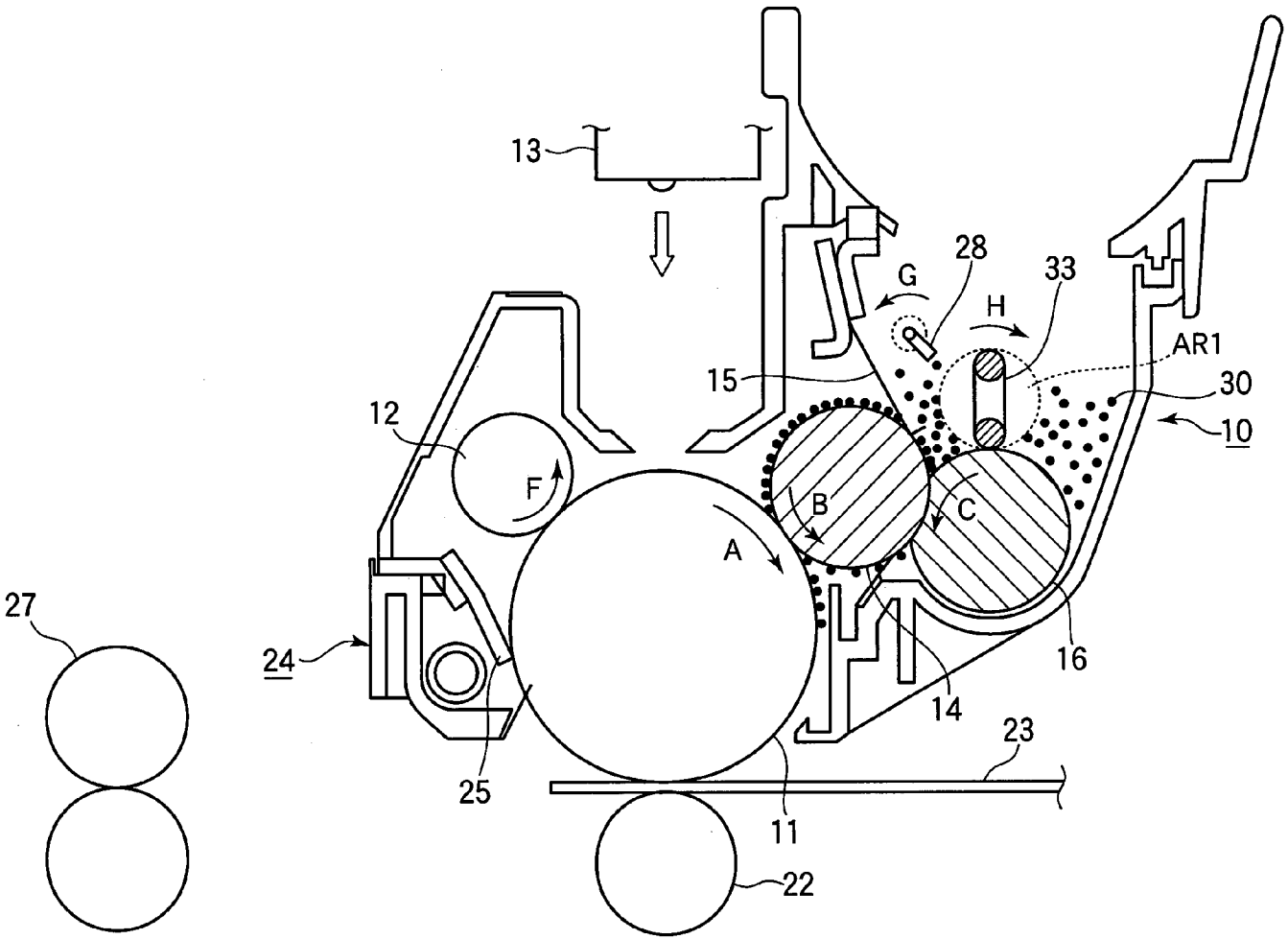
FIG. 1 is a schematic view of a printer according to a first embodiment of the invention.

FIG. 1 is a schematic view of a printer according to a first embodiment of the invention.

Referring to FIG. 1, an ID cartridge 10 is an image-forming cartridge of a printer. A photoconductive drum 11 rotates in a direction shown by arrow A. A charging roller 12 rotates in contact with the photoconductive drum 11 in a direction shown by arrow F and charges the entire circumferential surface of the photoconductive drum 11 uniformly. An exposing unit 13 takes the form of, for example, an LED head or a laser scanning device and illuminates the charged surface of the photoconductive drum 11 to form an electrostatic latent image thereon. A developing roller 14 rotates in a direction shown by arrow B in contact with the photoconductive drum 11 and supplies toner 30 to the electrostatic latent image to develop the electrostatic latent image into a toner image. A developing blade 15 restricts the thickness of a layer of toner formed on the developing roller 14, thereby setting an amount of toner that transfers from the developing roller 4 to the photoconductive drum 11. A toner-supplying roller 16 rotates in contact with the developing roller 14 in a direction shown by arrow C. The toner-supplying roller 16 is located immediately under a toner cartridge, not shown, and supplies the toner 30 to the developing roller 14.

An agitator 28 is disposed substantially over a nip formed between the toner-supplying roller 16 and the developing roller 14, and rotates in a direction shown by arrow G, thereby agitating the toner 30.

A toner-supplying body 33 is disposed in a region AR1 directly over the toner-supplying roller 16, i.e., the toner-supplying body 33 extends substantially parallel to the toner-supplying roller 16 so that they oppose each other or are adjacent to each other. The toner-supplying body 33 rotates in a direction shown by arrow H so that the toner-supplying body 33 moves into contact with the toner-supplying roller 16 periodically. The developing roller 14, developing blade 15, toner-supplying roller 16, agitator 28, and toner-supplying body 33 cooperate to form a developing unit.

A transfer roller 22 opposes the photoconductive drum 11 and defines a transfer point between the transfer roller 22 and the photoconductive drum 11. When a recording medium 23 enters the transfer point, the transfer roller 22 transfers a toner image formed on the photoconductive drum 11 onto the recording medium 23. The recording medium 23 can be a transparency as well as paper.

A cleaning unit 24 removes residual toner on the photoconductive drum 11 after transferring the toner image onto the recording medium 23. The cleaning unit 24 includes a cleaning blade 25 that is in contact with the surface of the photoconductive drum 11. The photoconductive drum 11, charging roller 12, developing unit, toner cartridge, cleaning unit 24 cooperate to form the ID cartridge 10.

There is provided a fixing unit 27 downstream of the transfer point with respect to the transport path of the recording medium 23. The fixing unit fixes the toner image on the recording medium 23.

The exposing unit 13 illuminates the charged surface of the photoconductive drum 11 in accordance with an image signal to form an electrostatic latent image. Subsequently, the developing roller 14 develops the electrostatic latent image with the toner 30 into a toner image. Then, the toner image is transferred by the transfer roller onto the recording medium. The recording medium is advanced to the fixing unit 27 where the toner image is fused into a permanent image.

The developing unit will be described. The developing unit is of the single component developer type. Thus, the toner 30 is a single component developer. The toner cartridge has an opening that can be opened and closed. When the opening is opened, a predetermined amount of toner 30 falls from the toner cartridge through the opening into the developing unit. As the agitator 28 rotates, the toner 31 is agitated by the agitator 28 and is supplied to the toner-supplying roller 16. The rotation of the toner-supplying body 33 causes the toner 30 to move toward the developing lade 15 and the agitator 28 operates to disperse the toner 30 near the developing blade 15.

The toner-supplying roller 16 and the developing roller 14 rotate in contact with each other in the same direction but at different speeds. The potential difference between the toner-supplying roller 16 and the developing roller 14 causes the toner 30 to move from the toner-supplying roller 16 to the developing roller 14. The toner-supplying roller 16 also functions to remove excess toner from the circumferential surface of the developing roller 14. The toner-supplying roller 16 is formed of a foamed resilient material such as silicone rubber and urethane rubber, and has a plurality of cells in the shape of a recess in the circumferential surface.

The toner 30 at the nip is lightly charged due to the friction created by the differences in circumferential speed and rotational direction between the toner-supplying roller 16 and developing roller 14.

As the developing roller 14 rotates, the toner 30 on the developing roller 14 is delivered to the developing blade 15, which in turn restricts the thickness of layer of toner. Then, the layer of toner is brought to the developing point where the toner is attracted to the electrostatic latent image on the photoconductive drum 11 by the Coulomb force, thereby forming a toner image on the photoconductive drum 11.

As the toner-supplying roller 16 rotates in the C direction, the cells in the toner-supplying roller 16 scrape the toner 30 surrounding the toner-supplying roller 16, thereby supplying the toner 30 to the developing roller 14. When the toner 30 passes the nip formed between the developing roller 14 and the toner-supplying roller 16, the toner 30 is subjected to mechanical stress and heat generated during printing. As a result, the toner 30 loses its fluidity and becomes packed near the toner-supplying roller 16 after repetitive printing cycles over time. The agglomeration of toner tends to prevent the particles of the toner 30 from moving.

Therefore, the ability of the toner-supplying roller 16 to scrape the toner 30 is impaired, so that the amount of toner supplied to the developing roller 14 decreases. Especially, because the mechanical stress exerted on the toner in the region AR1 is large, the impaired ability of the toner-supplying roller 16 reduces the toner 30 supplied to the developing roller 14.

This causes blurring of print images and hence poor print quality. For solving this problem, the toner-supplying body 33 is disposed in the region AR1.

Figure 2A:
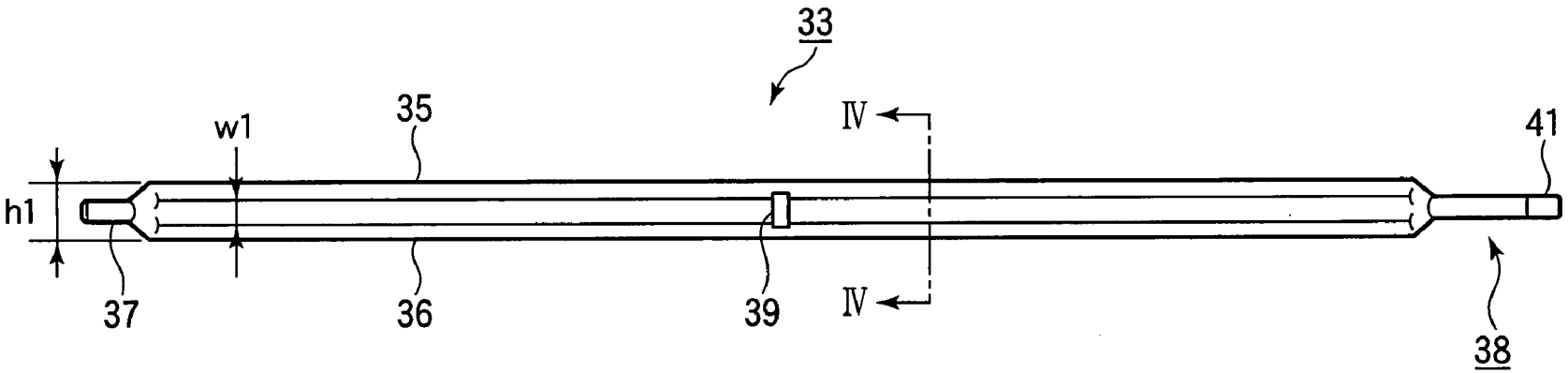
FIG. 2A is a front view of a toner supplying body according to the first embodiment.

FIG. 2A is a front view of a toner-supplying body according to the first embodiment.

Figure 2B:
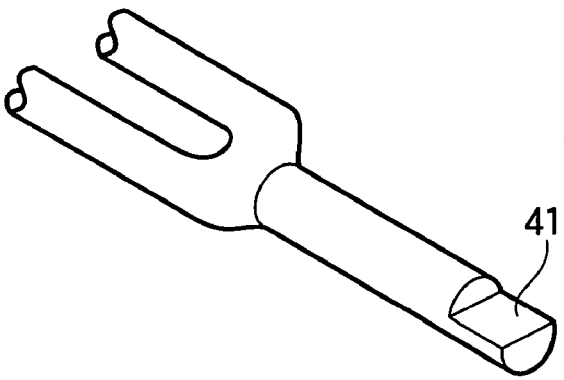
FIG. 2B is a fragmentary perspective view of the toner-supplying body.

FIG. 2B is a fragmentary perspective view of the toner-supplying body.

Figure 2C:
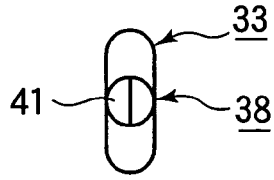
FIG. 2C is a side view of the toner-supplying body.

FIG. 2C is a side view of the toner-supplying body.

Figure 3:
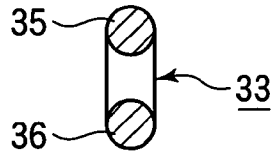
FIG. 3 is a side view of the toner-supplying body.

FIG. 3 is a side view of the toner-supplying body.

Figure 4:
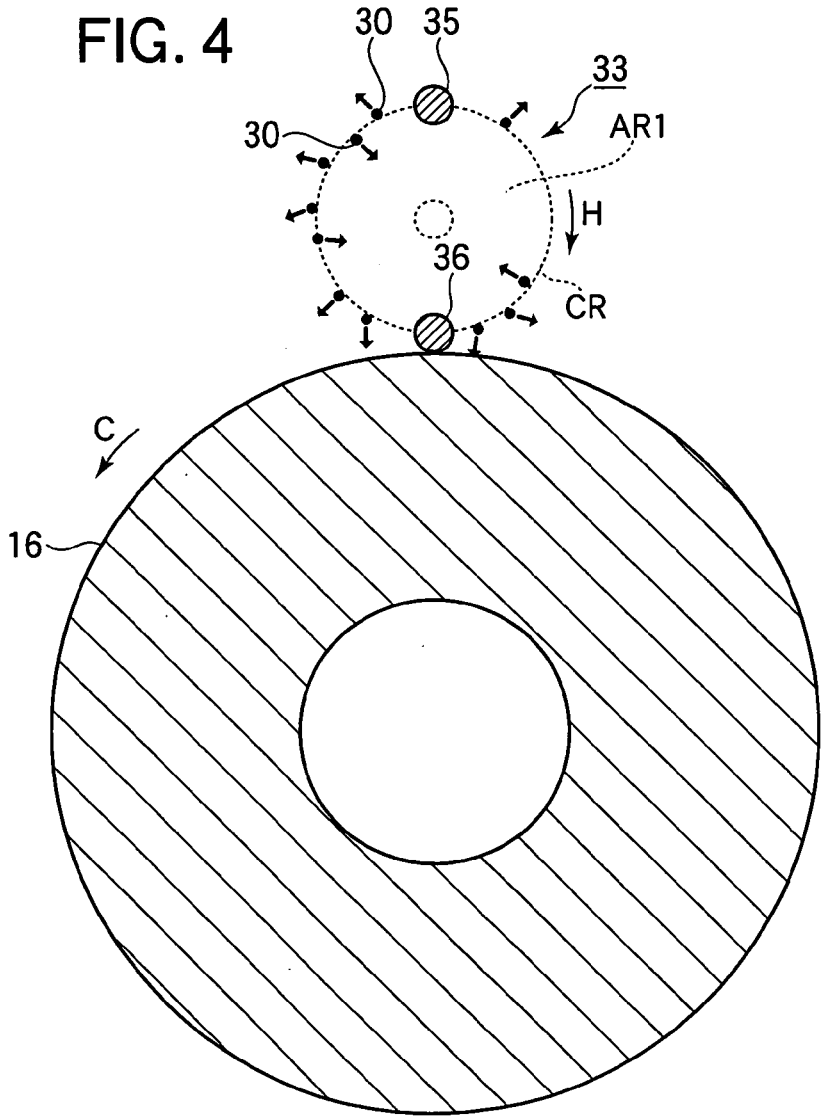
FIG. 4 is a cross-sectional view taken along line IV-IV of FIG. 2A, illustrating the positional relation between the toner-supplying body and the toner-supplying roller.

FIG. 4 is a cross-sectional view taken along line IV-IV of FIG. 2.

The toner-supplying body 33 is formed of, for example, ABS resin, and has substantially the same axial dimension as the toner-supplying roller 16. The toner-supplying body 33 includes two parallel rods 35 and 36 having a circular cross section. The two rods 35 and 36 are connected together at their longitudinal ends and at their longitudinally middle portions via a connection 39, so that the toner-supplying body 33 has a generally flat overall shape with a width of about 10 mm. The toner-supplying body 33 has rotational shafts 37 and 38 formed at its longitudinal end portions about which the toner-supplying body 33 rotates. The two rods 35 and 36 are spaced apart by a distance W1, which can be selected depending on the dimension and characteristics of the developing unit. A plurality of connections 39 may be employed at appropriate locations between the two rods 35 and 36, thereby preventing the toner-supplying body 33 from deforming or flexing due to the pressure exerted by the toner 30.

The rotational shaft 38 is in the shape of a deformed cylinder that has been partially cut away in a plane parallel to its longitudinal axis. The drive portion 41 is coupled to a drive source, not shown, through a drive force transmitting mechanism such as gears, so that the toner-supplying body 33 is driven in rotation at a predetermined speed. As the toner-supplying body 33 rotates, the rods 35 and 36 are brought alternately into contact engagement with the toner-supplying roller 16.

FIG. 4 illustrates the positional relation between the toner-supplying body and the toner-supplying roller.

When the toner-supplying body 33 rotates in a direction shown by arrow H, the rods 35 and 36 move in a circular path CR. The rods 35 and 36 alternately contact the toner-supplying roller 16 to push the toner 30 near the circumferential surface of the toner-supplying roller 16 in a direction tangential to the surface of the toner-supplying roller 16. This motion of the rods 35 and 36 efficiently supplies the toner 30 to the developing roller 14, preventing printed images from being blurred as well as improving print quality.

When the rods 35 and 36 move in the circular path CR, they push the toner 30 out of the way, most of the toner 30 being pushed outwardly relative to the region AR1 and some of the toner 30 being pushed inwardly relative to the region AR1. A fraction of the toner 30 pushed outwardly relative to the region AR1 will move toward the toner-supply roller 16. When the rods 35 and 36 move in the circular path CR, there will be created a cylindrical gap having a diameter of W1. This gap causes a fraction of the toner 30 pushed inwardly relative to the region AR1 to move toward the toner-supplying roller 16. Thus, the toner 30 is not restricted its movement so that the toner 30 can move around within the region AR1.

In this manner, the flow of toner 30 is created so that the packed toner 30 can be efficiently agitated and the gravity-fed toner on the toner-supplying roller 16 experiences less mechanical stress. Thus, the toner 30 can be supplied more efficiently to the developing roller 16.

Table 1 lists results when the toner-supplying body 33 is provided in the developing unit and test results when the toner-supplying body 33 is not provided in the developing unit.

TABLE 1

| Number of printed pages | toner-supplying body is not provided | toner-supplying body is provided |
|---|---|---|
| 2500 | ○ | ○ |
| 5000 | X | ○ |
| 7500 | X | ○ |
| 10000 | X | ○ |
| 12500 | X | ○ |
| 15000 | X | ○ |

Symbol ○ indicated that printed images were not blurred. Symbol X indicated that printed images were blurred. Continuous printing was performed on a predetermined number pages of A4 size paper without an image signal sent to the exposing unit 13. Subsequently, printing was performed on pages of A4 size paper with an image signal sent to the exposing unit 23 to print solid images, thereby determining whether printed images were blurred. Printing was first performed without an image signal fed to the exposing unit 13. This is done to accurately determine whether agglomeration of toner occurs. The solid image images were printed on the entire print region of the A4 size paper at a print duty of 100%. If a decrease in density of printed image due to insufficient toner supply occurred, it was determined that blurring of image occurred.

Continuous printing was performed for pages in increments of 2500 pages.

The toner-supplying body 33 according to the embodiment is formed of ABS resin. However, the toner-supplying body 33 may be formed of a metal material or other materials, provided that the toner-supplying body 33 can maintain its shape during rotation. While the rods 35 and 36 have a circular cross-section, the cross section may be of other shapes, for example, a polygon.

Figure 5:
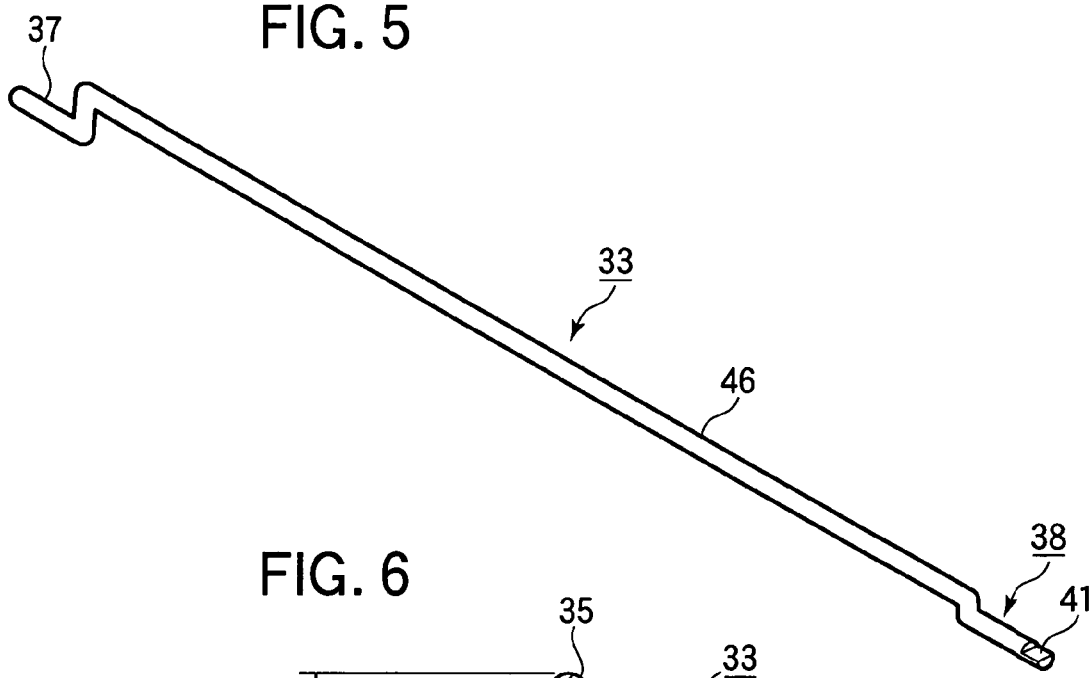
FIG. 5 illustrates another example of the toner-supplying body.

FIG. 5 illustrates another example of the toner-supplying body. In the present embodiment, while the toner-supplying body 33 includes two rods 35 and 36, the toner-supplying body 33 may have a single rod 46 such as that shown in FIG. 5 or more than three rods that extend in parallel to the toner-supplying roller 16. When the toner-supplying body 33 includes a single crank pin 46, the toner-supplying body 33 takes the shape of a crank such that the crank pin 46 is eccentric to the rotational shafts 67 and 38. The toner-supplying body 33 is preferably formed of two rods 35 and 36 so that the toner-supplying body 33 is well balanced and the toner 30 can smoothly move within the region AR1.

In the present embodiment, the toner-supplying body 33 rotates in a direction opposite to the toner-supplying roller 16. However, the toner-supplying body 33 may rotate in the same direction as the toner-supplying roller 16, provided that the toner-supplying body 33 is capable of agitating the toner 30 and pushes the toner outwardly relative to the circular path CR. The toner-supplying body 33 may be rotated at the same speed as the toner-supplying roller 16.

The present embodiment is particularly effective when the toner cartridge is located over the toner-supplying roller 16. For example, a color electrophotographic printer includes EP cartridges for respective colors aligned in a line. For this type of configuration, the toner cartridge needs to be positioned over the developing unit and therefore the embodiment is particularly useful.

Second Embodiment

Figure 6:
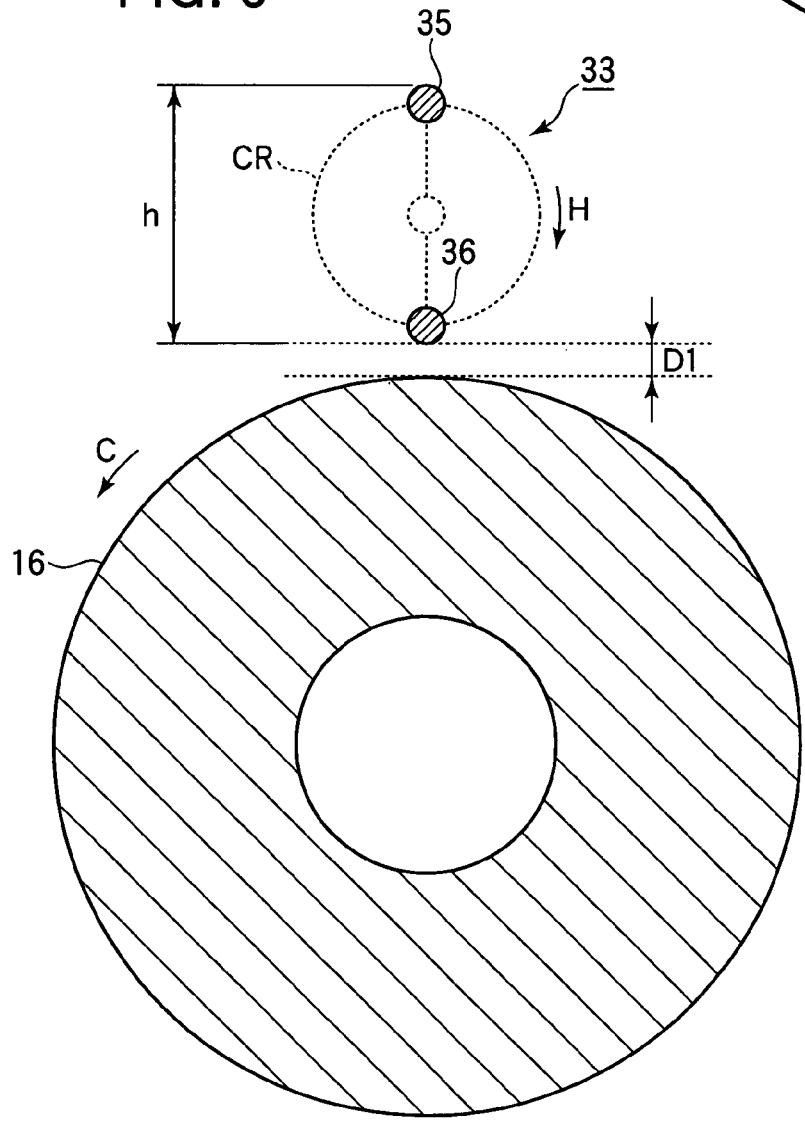
FIG. 6 illustrates a toner-supplying body according to a second embodiment.

FIG. 6 illustrates a toner-supplying body 33 according to a second embodiment.

Figure 7:
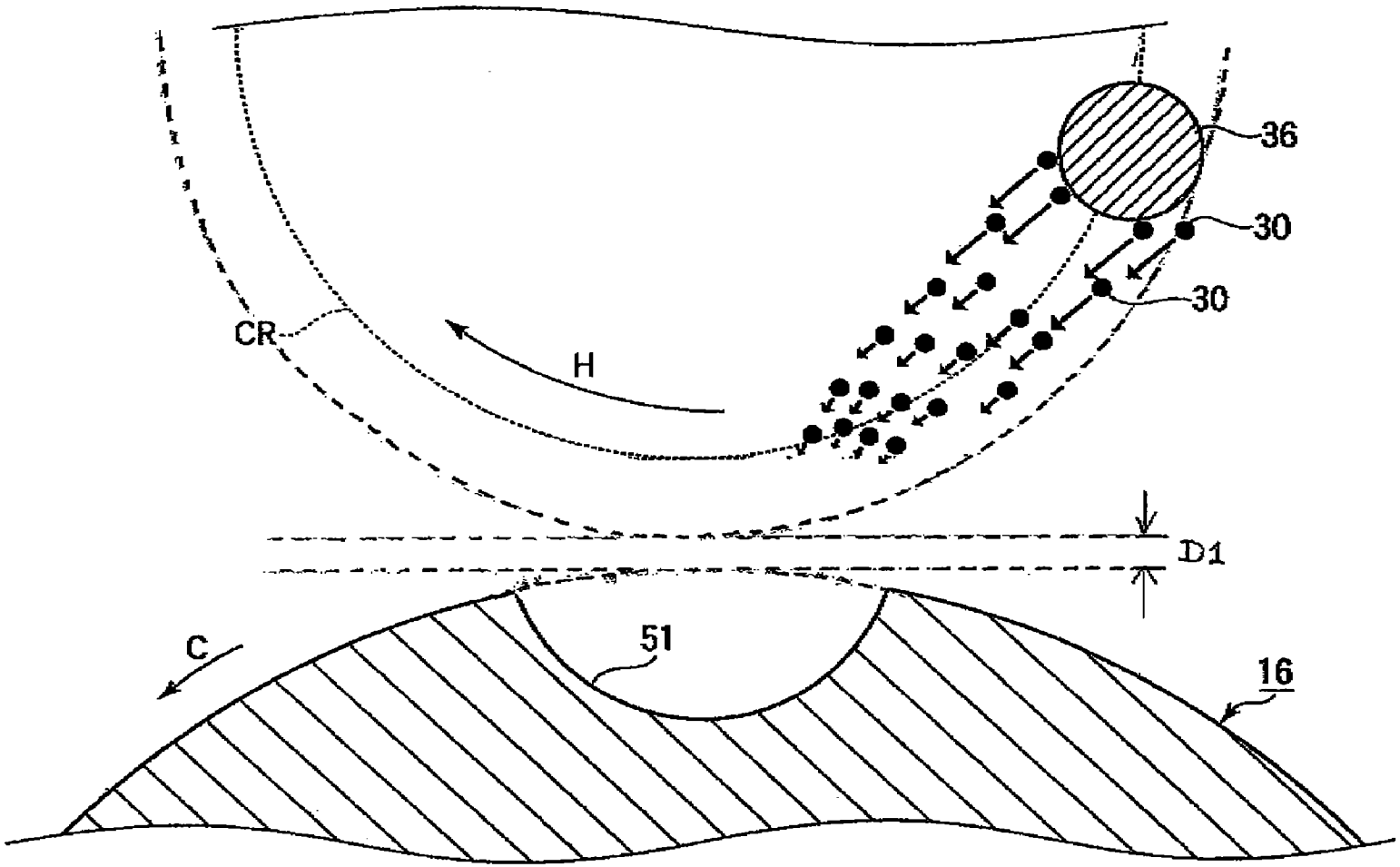
FIG. 7 illustrates the operation of the toner-supplying body according to the second embodiment.

FIG. 7 illustrates the operation of the toner-supplying body 33 according to the second embodiment.

The toner-supplying body 33 according to the second embodiment has a width h1 smaller than 10 mm and rotates in such a way that the rods 35 and 36 will not contact the toner-supplying roller 16. In other words, when the toner-supplying body 33 rotates, the bottom dead center of the rods 35 and 36 is a distance D1 away from the circumferential surface of the toner-supplying roller 16.

Because the rods 35 and 36 do not contact the toner-supplying roller 16, the toner-supplying body 33 exerts no load on the toner-supplying roller 16. This ensures stable rotation of the toner-supplying roller 16 and therefore a drive source of the toner-supplying body 33 can be a motor having a small rating, which can help reduce production cost of a printer.

The rotation of the toner-supplying roller 16 in the C direction causes the toner 30 surrounding the toner-supplying roller 16. If the toner-supplying body rotates in such a way that the rods 35 and 36 alternately contact the toner-supplying roller 16, then the toner 30 moved to the toner-supplying roller 16 will be scraped by the cells formed in the circumferential surface of the toner-supplying roller 16.

If the toner-supplying body 33 and the toner-supplying roller 16 are spaced apart by the distance D1, adjacent particles of toner 30 that have moved to the toner-supplying roller 16 due to the rotation of the toner-supplying body 33 will collide with one another in a pileup fashion. In this manner, the collision forces are transmitted from particle to particle. If the distance D1 is large, then the forces are absorbed in the space, failing to push the particles of toner 30 near the toner-supplying roller 16. For this reason, the distance D1 should be less than a certain value.

TABLE 2

| Number of printed pages | Toner-supplying body is provided h1 = 10 D1 = 0 (mm) | h1 = 9.2 D1 = 0.4 (mm) | h1 = 8.4 D1 = 0.8 (mm) | h1 = 8 D1 = 1.0 (mm) | Toner-supplying body is not provided |
|---|---|---|---|---|---|
| 2500 | X | ○ | ○ | ○ | ○ |
| 5000 | ○ | ○ | ○ | ○ | ○ |
| 7500 | ○ | ○ | ○ | ○ | X |
| 10000 | ○ | ○ | ○ | X | X |
| 12500 | ○ | ○ | ○ | X | X |
| 15000 | ○ | ○ | ○ | X | X |

When the width h1 is 10 mm, the distance D1 is 0 mm. When the width h1 is 9.2, 8.4, and 8 mm, the toner-supplying body 33 and toner-supplying roller 16 do not contact each other.

When the distance D1 is in the range of 0 to 0.8 mm, printed images are not blurred after printing 1000 pages. When the distance D1 is not shorter than 1 mm, the printed images are blurred even though the toner-supplying body 33 is provided. The comparison results reveal that if no blurring is detected for 10,000 pages there will be no problem within the dates set for safe consumption of the most ID cartridges 10. Thus, the distance D1 is preferably not longer than 0.8 mm.

In the first and second embodiments, the toner cartridge is located over the toner-supplying roller 16. New, fresh toner 30 falls by gravity onto the region AR1 in which the cell 51 scrapes the toner particles, and therefore the toner 30 is subjected to large mechanical stresses. New, fresh toner 30 outside of the region AR1 is subjected to relatively small mechanical stresses and therefore the toner 30 will not become packed. Therefore, the particles of toner 30 acquire a large amount of charge and the particles are easy to move.

Third Embodiment

A third embodiment is directed to supplying toner from areas outside of the region AR1 into the region AR1.

Figure 8:
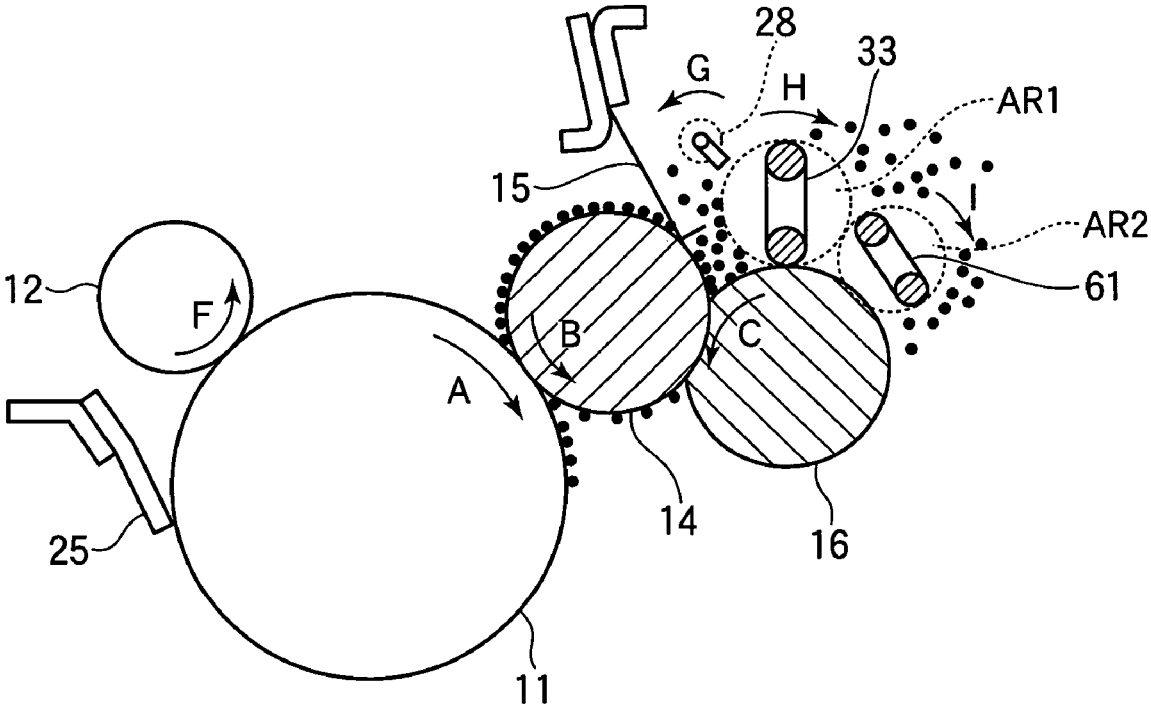
FIG. 8 is a schematic view of a printer according to a third embodiment.

FIG. 8 is a schematic view of a printer according to the third embodiment.

Figure 9:
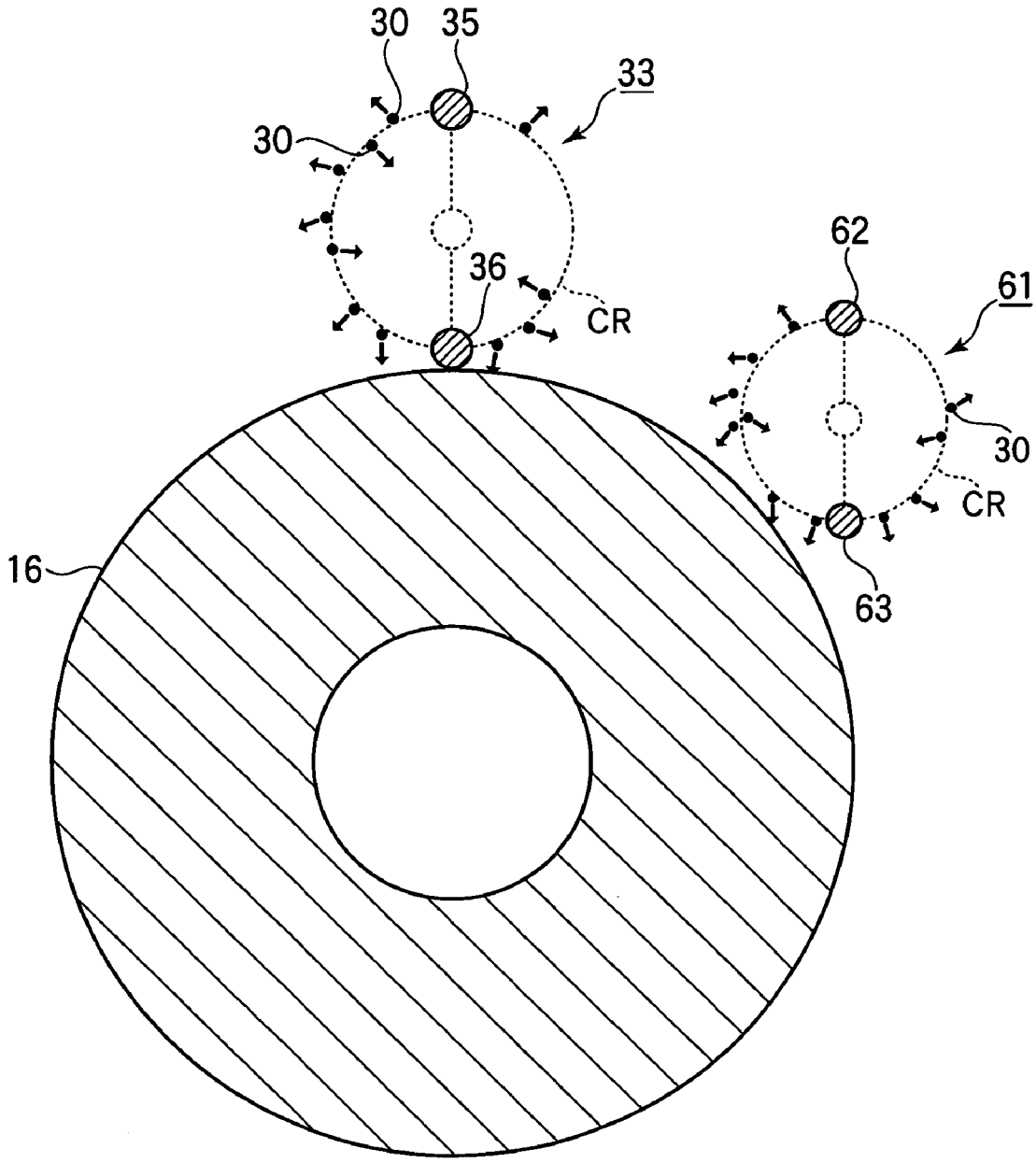
FIG. 9 illustrates a toner-supplying body according to the third embodiment.
Figure 10:
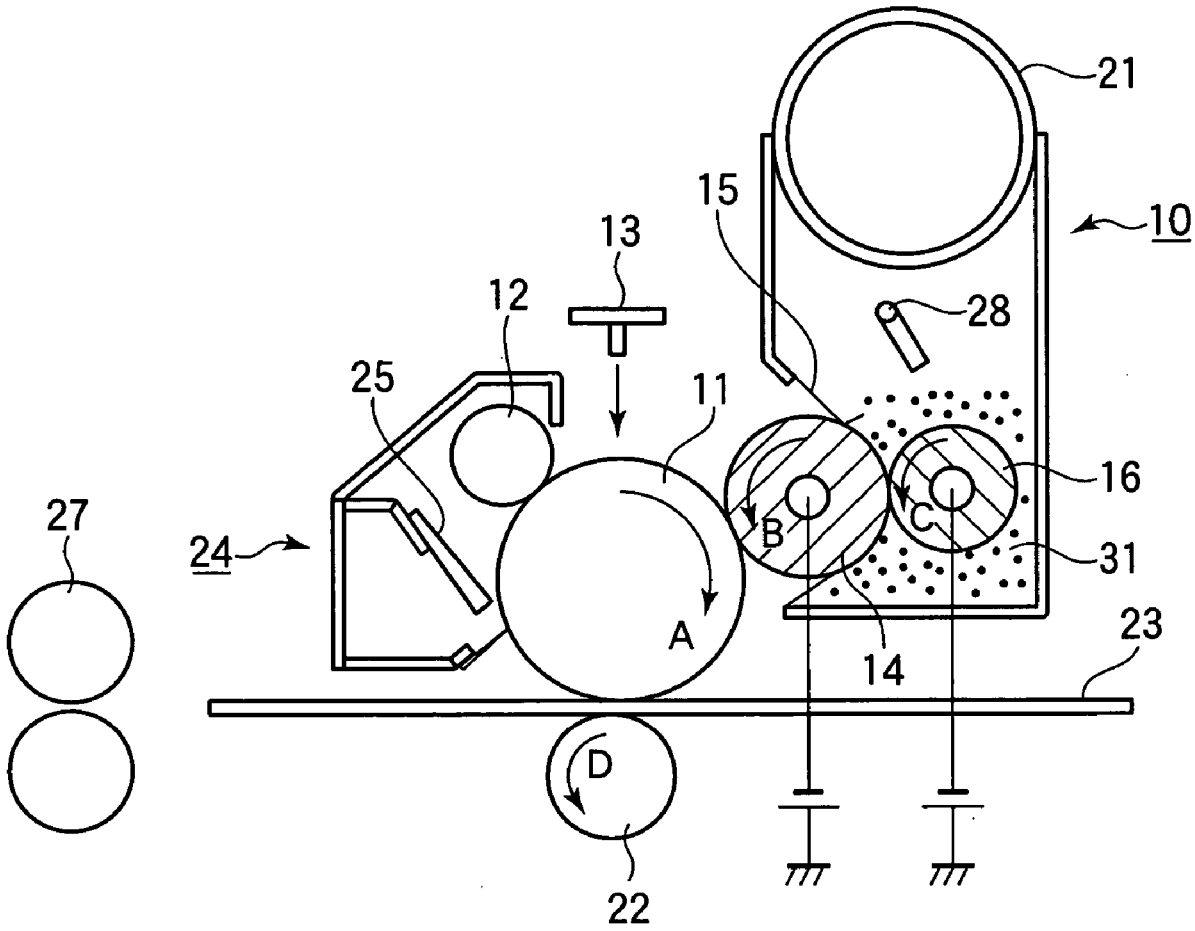
FIG. 10 CONVENTIONAL ART
FIG. 10 is a schematic view of a conventional printer.
Figure 11:
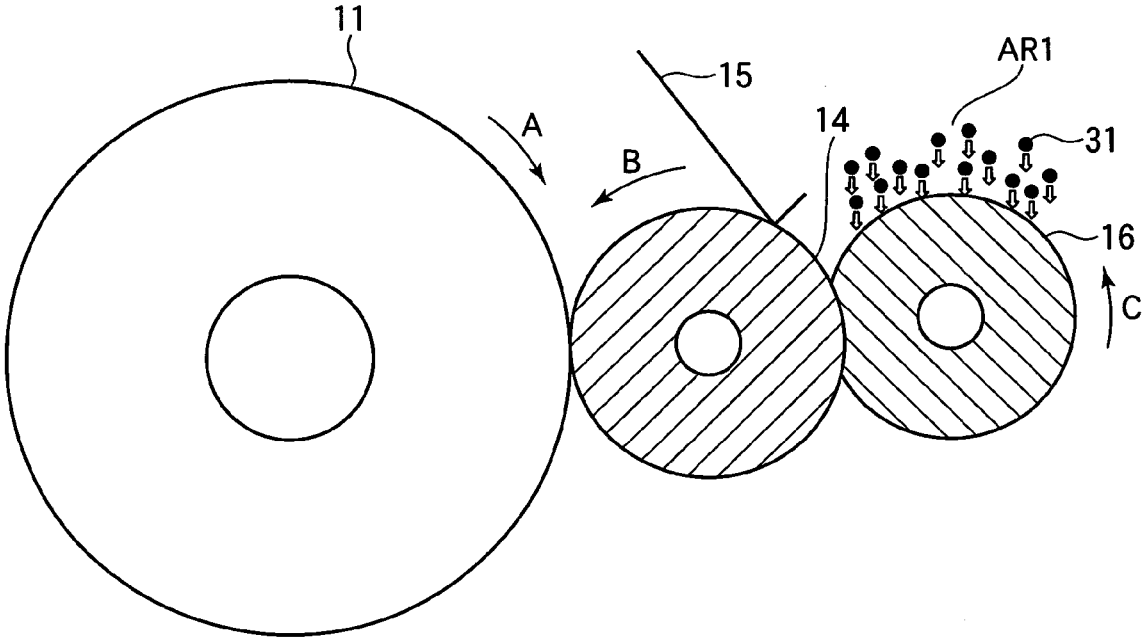
FIG. 11 CONVENTIONAL ART
FIG. 11 illustrates the operation of a conventional developing apparatus.

FIG. 9 illustrates a toner-supplying body according to the third embodiment.

Element similar to those in the first and second embodiment have been given the same reference numerals and the description thereof is omitted.

A toner-supplying body 33 is disposed directly over a toner-supplying roller 16 and rotates in a direction shown by arrow H in such a fashion that two rods 35 and 36 of the toner-supplying body 33 alternately and periodically contact the circumferential surface of the toner-supplying roller 16. The toner-supplying body 33 rotates to define a region AR1. At least an additional toner-supplying body 61 is disposed immediately upstream of the region AR1 and rotates in a direction shown by arrow I to define a region AR2. In other words, the toner-supplying body 61 extends substantially parallel to the toner-supplying roller 16 so that they oppose each other or are adjacent to each other. It is desirable that the region AR2 opposes at least part of the upper half of the circumferential surface of the toner-supplying roller 16.

The toner-supplying body 61 is also formed of ABS resin and has substantially the same axial dimension as the toner-supplying roller 16. The toner-supplying body 33 includes two parallel rods 62 and 63 having a circular cross section. The two rods 62 and 63 are connected to each other at their longitudinal ends and at their longitudinally middle portions via a connection 39. The toner-supplying body 61 has rotational shafts, not shown, at its longitudinal ends. The two rods 62 and 63 are spaced apart by a distance. The toner-supplying body 61 rotates in such a fashion that the two rods 62 and 63 of the toner-supplying body 61 alternately and periodically contact the circumferential surface of the toner-supplying roller 16.

New, fresh toner 30 within the region AR2 is subjected to relatively small mechanical stress and therefore the toner 30 will not become packed. Therefore, the particles of toner 30 acquire a large amount of charge and the particles are easy to move.

The rotation of the toner-supplying body 61 in the I direction causes the toner 30 in the region AR2 to move in the C direction into the region AR1. As a result, the toner 30 can be transferred to the developing roller 14 more efficiently, so that the printed images may be free of blurring and print quality is improved.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developing apparatus comprising:

a developer bearing body that applies developer to an electrostatic latent image formed on an image bearing body to develop the electrostatic latent image with the developer into a visible image;

a first developer-supplying member formed of a foamed material, said first developer-supplying member rotating in contact with said developer bearing body to supply the developer to said developer bearing body;

at least one second developer-supplying member disposed over said first developer-supplying member, said second developer-supplying member being adjacent to an upper surface of said first developer-supplying member and having at least one rod, the at least one rod rotating about an axis extending in the developing apparatus to define a cylindrical space concentric to the axis such that the at least one rod rotates around the cylindrical space, wherein when said second developer-supplying member rotates about the axis, the at least one rod periodically approaches said first developer-supplying member to supply the developer to said first developer-supplying member;

wherein when the at least one rod is closest to said first developer-supplying member, said second developer-supplying member and said first developer-supplying member are either in contact with each other or are spaced apart by a predetermined distance.

2. The developing apparatus according to claim 1, wherein said second developer-supplying member is configured such that when said second developer-supplying member operates, the at least one rod includes two diametrically opposed rods that alternatively approach said first developer-supplying member.

3. A developing apparatus comprising:

a developer bearing body that applies developer to an electrostatic latent image formed on an image bearing body to develop the electrostatic latent image with the developer into a visible image;

a first developer-supplying member formed of a foamed material, said first developer-supplying member rotating in contact with said developer bearing body to supply the developer to said developer bearing body;

at least one second developer-supplying member disposed over said first developer-supplying member, said second developer-supplying member being adjacent to an upper surface of said first developer-supplying member and having at least one rod, the at least one rod rotating about an axis extending in the developing apparatus to define a cylindrical space concentric to the axis such that the at least one rod is spaced from the axis and rotates around the cylindrical space, when said second developer-supplying member rotates about the axis, the at least one rod periodically approaches the first developer-supplying member to supply the developer to said first developer-supplying member;

wherein when said second developer-supplying member is closest to said first developer-supplying member, said second developer-supplying member and said first developer-supplying member are either in contact with each other or are spaced apart by a predetermined distance;

and wherein the developer is supplied from over said first developer-supplying member.

4. The developing apparatus according to claim 1, wherein the at least one rod comprises at least two diametrically opposed rods that become alternately closest to said first developer-supplying member.

5. The developing apparatus according to claim 3, wherein said second developer-supplying member includes a first member and a second member disposed adjacent to each other.

6. The developing apparatus according to claim 1, wherein the predetermined distance is not longer than 0.8 mm.

7. An image forming apparatus that incorporates a developing apparatus according to claim 3.

8. The developing apparatus according to claim 5, wherein the predetermined distance is not longer than 0.8 mm.

9. The developing apparatus according to claim 8, wherein the axis of said second developer-supplying member extends substantially in parallel to said first developer-supplying member.

10. The developing apparatus according to claim 9, wherein the at least one rod includes two diametrically opposed rods.

11. The developing apparatus according to claim 10, wherein said second developer-supplying member is configured such that when said second developer-supplying member operates, the two rods alternately approach said first developer-supplying member.

12. The developing apparatus according to claim 9, wherein the at least one rod includes a plurality of parallel rods that extend parallel to the axis, wherein the plurality of rods become alternately closest to said first developer-supplying member.

* * * * *